US008336256B2

(12) United States Patent
Jeffrey et al.

(10) Patent No.: US 8,336,256 B2
(45) Date of Patent: Dec. 25, 2012

(54) AUTOMATED LOUVRE SYSTEM

(75) Inventors: Craig Robert Jeffrey, Queensland (AU); Ian David Underhill, Queensland (AU)

(73) Assignee: Assa Abloy Australia Pty Ltd, Victoria (AU)

( * ) Notice: Subject to any disclaimer, the term of this patent is extended or adjusted under 35 U.S.C. 154(b) by 996 days.

(21) Appl. No.: 12/158,549

(22) PCT Filed: Dec. 13, 2006

(86) PCT No.: PCT/AU2006/001892

§ 371 (c)(1),
(2), (4) Date: Dec. 1, 2008

(87) PCT Pub. No.: WO2007/070926

PCT Pub. Date: Jun. 28, 2007

(65) Prior Publication Data

US 2009/0307978 A1 Dec. 17, 2009

(30) Foreign Application Priority Data

Dec. 20, 2005 (AU) ..... 2005907143
Apr. 11, 2006 (AU) ..... 2006901890

(51) Int. Cl.
*E06B 7/08* (2006.01)

(52) U.S. Cl. ..... 49/74.1; 49/82.1; 454/221; 454/224

(58) Field of Classification Search ..... 49/74.1, 49/82.1, 86.1; 454/369, 256, 278, 196–227
See application file for complete search history.

(56) References Cited

U.S. PATENT DOCUMENTS

| | | | | |
|---|---|---|---|---|
| 2,220,405 | A * | 11/1940 | Jones | 49/86.1 |
| 4,559,867 | A * | 12/1985 | Van Becelaere et al. | 454/369 |
| 5,216,837 | A | 6/1993 | Cleaver et al. | |
| 5,600,920 | A * | 2/1997 | Roy | 49/64 |
| 7,963,071 | B2 * | 6/2011 | Alexander et al. | 49/403 |
| 2005/0120628 | A1 | 6/2005 | Yedidya | |
| 2007/0261307 | A1 * | 11/2007 | Alexander | 49/82.1 |

FOREIGN PATENT DOCUMENTS

| | | |
|---|---|---|
| DE | 20001783 | 6/2000 |
| EP | 0 563 014 | 9/1993 |
| JP | 09-072168 | 3/1997 |
| WO | 02/01031 | 1/2002 |

OTHER PUBLICATIONS

International Search Report for Application No. PCT/AU2006/001892 filed Dec. 13, 2006.

* cited by examiner

*Primary Examiner* — Katherine W Mitchell
*Assistant Examiner* — Catherine A Kelly
(74) *Attorney, Agent, or Firm* — Renner, Otto, Boisselle & Sklar, LLP

(57) ABSTRACT

A motorized drive system for a louvre assembly of the type containing a surround frame, a pair of spaced apart operating bars positioned within the surround frame and where movement of the operating bars causes rotation of the louvres, the drive system comprising a motor adapted to be positioned within the surround frame, the motor operationally driving a drive shaft which is substantially horizontal when the drive system is fitted within the surround frame, a mounting member which is attached for rotation with the drive shaft, at least two spaced apart attachment points on the mounting member, a first link arm, a second link arm and a third link arm, the first link arm being attached to one of the attachment points and to one said operating bar, the second link arm being attached to another of the attachment points, the third link arm being pivotally attached to the second link arm and to the other operating bar.

21 Claims, 6 Drawing Sheets

OPEN VIEW

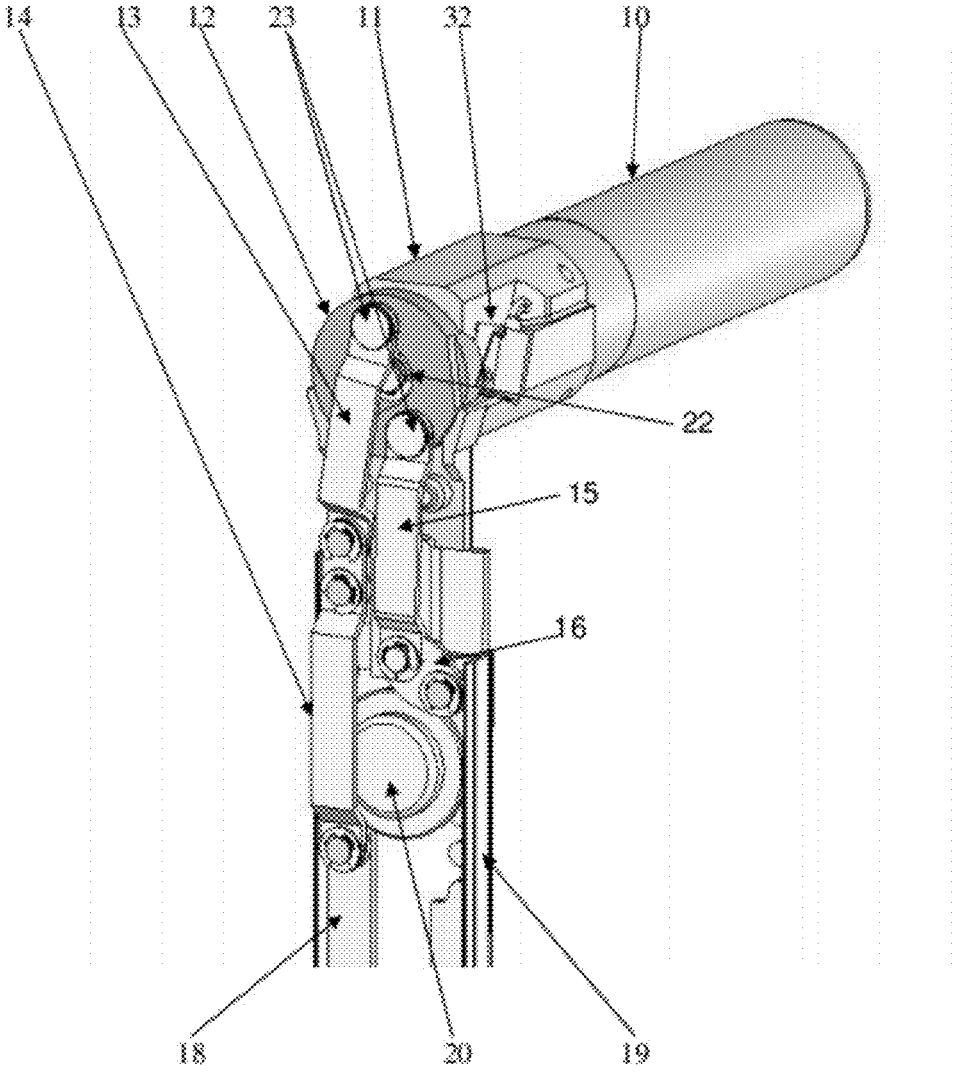
FIG 1 PERSPECTIVE VIEW OPEN

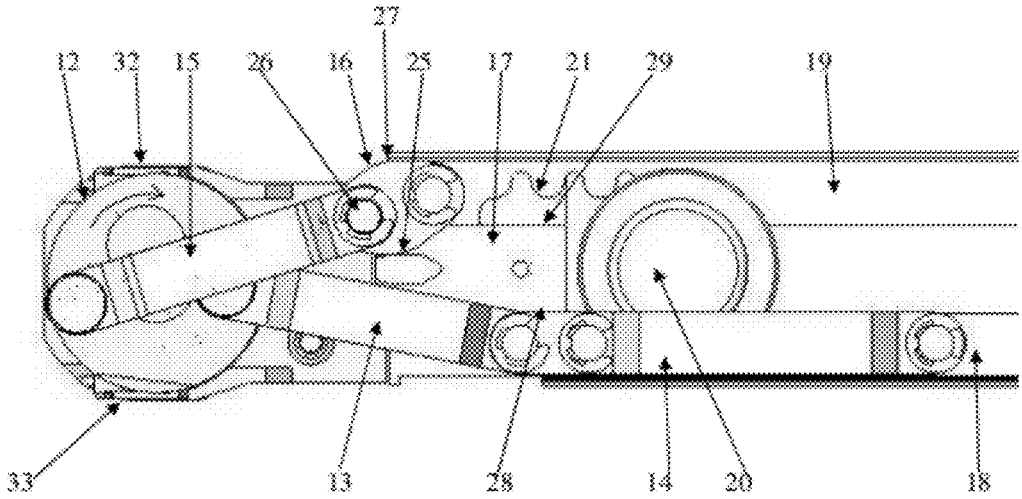
FIG 2 CLOSED VIEW
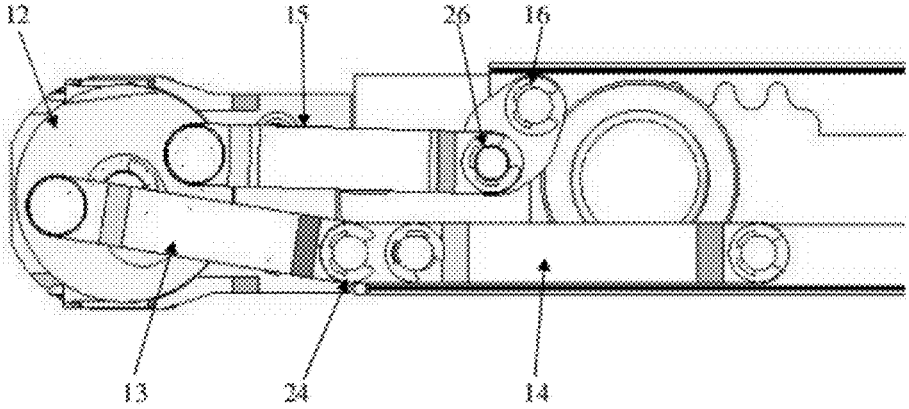
FIG 3 OPEN VIEW

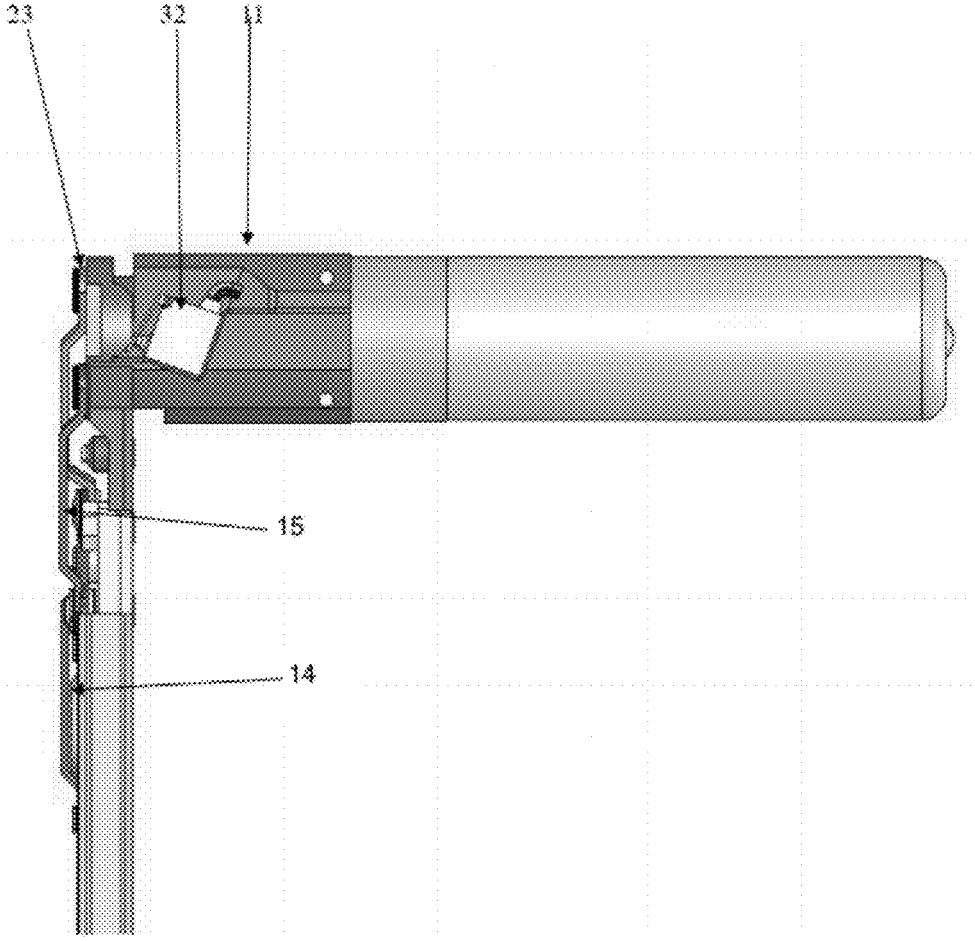
FIG 4 SIDE VIEW

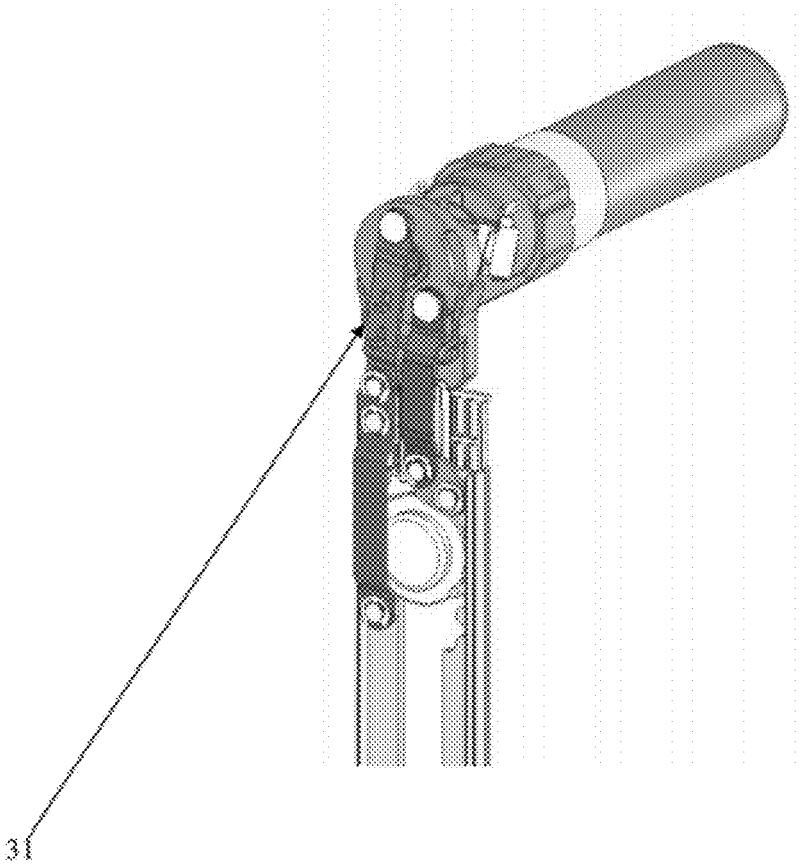
FIG 7 MODIFIED FIRST LINK ARM
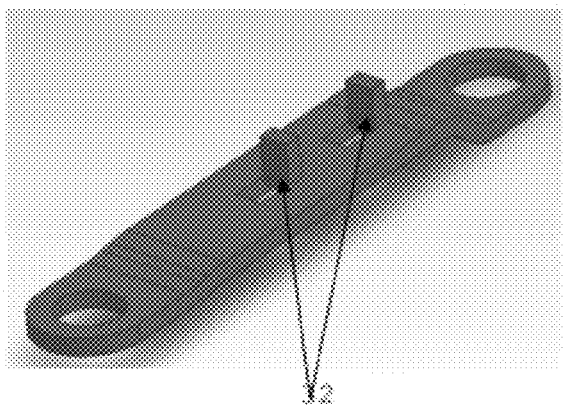
FIG 8 CLOSE UP OF MODIFIED FIRST LINK ARM

AUTOMATED LOUVRE SYSTEM

FIELD OF THE INVENTION

This invention is directed to an automated louvre system and is particularly directed to a mechanism for operating a set of louvres using an electric or similar rotating motor. The louvre system will typically comprise a louvre window.

BACKGROUND ART

A louvre window assembly typically comprises a plurality of louvres which are fitted in a frame. The louvres can move between a substantially horizontal open position and a substantially vertical closed position. The louvres are typically made of glass, although it is also known to have wooden or metal louvres. The louvres are typically rectangular, and will commonly have a length of between 40-100 cm and a width of between 10-30 cm, and the thickness of a few millimeters (for metal louvres) and typically between 4-8 mm for glass louvres.

A typical louvre window assembly will have between 5-25 louvres. Each louvre contains a pair of end clips typically made of plastic (although the older ones were made of metal). The surround frame contains a louvre operating mechanism. A typical louvre operating mechanism comprises a pair of long metal strips which are called operating bars. These metal strips are spaced apart typically between 5-40 mm and are positioned in a vertical part of the surround frame. The metal strips are operatively connected to a circular disk member, and one of the end clips is attached to the circular disk member. The metal strips can reciprocate with one metal strip moving upwardly and one metal strip moving downwardly and this movement causes the circular disk member to rotate, which causes the louvre to open and close. A handle is then attached typically to the metal strips and operation of the handle in an up-and-down manner operates the metal strips and therefore opens or closes the louvres. Because of the load on the system, a handle is typically used to operate between 4-10 louvres.

The present invention is directed, in one form, to a drive system which can operate the louvre system of the type described above.

It is known to provide an automated louvre system. For instance, it is known to provide an electric motor drive which drives the louvres via the protruding handle. That is, the drive is attached to the handle and is a "retrofit" kit. This arrangement is bulky and unsightly and is generally not suitable.

There are many considerations that must be taken into account when automating a louvre system. Firstly, if the louvre system will form part of an external louvre window assembly, security is an issue. To explain, a manually operated louvre system can be locked in the closed position in general by locking the handle closed.

In an automated system, it is advantageous to have an automated mechanism which can also ensure that the louvres can be locked in the closed position and cannot simply be forced back into the open position from the outside of the louvre window assembly. Thus, small drive motors have generally not been acceptable as the resistance in these drive motors is generally small and an intruder can force the louvre from the closed position to the open position which will simply cause rotation of the drive motor in the counter direction. Large drive motors with a high degree of resistance are unsuitable because of their size and cost.

However, there is an advantage in being able to conceal the drive motor and the mechanism that connects to drive motor to the operating bars in the vertical part of the louvre surround frame, and one way that this could be done is to conceal the drive motor within part of the louvre surround frame. However, to do so, the drive motor needs to be quite small.

It is also necessary to ensure that the louvre blades can be closed quite tightly together to ensure an acceptable level of resistance to water and air penetration between the louvre blades. In a manual system, this can be done by forcing the external handle to the closed position. However, this presents a difficulty if a concealed (and therefore small) drive motor is desired as the motor may not have enough power to apply sufficient load to the blades. The solution of simply having a large motor is not considered acceptable because of the size and cost.

It is known to provide a louvre door with a plurality of small wooden slats positioned within the door frame to provide ventilation. The wooden slats can be pivoted between the open and closed position by a pushrod and a pushrod is typically positioned substantially midway along the slats such that it can be pushed up-and-down manually. It is known to provide a drive motor which is concealed within the wooden frame and which operates the wooden slats, presumably by moving the pushrod. This drive motor can be made quite small and uses a range of cogs to convert the rotary motion to a linear motion. This type of arrangement would be unsuitable for a louvre window system and especially an external louvre window system which requires security and sufficient load on the louvres themselves to prevent ingress of water/wind etc. The drive motor is designed only to open and close the wooden slats, and there is no need to provide any additional security, loading etc.

It is also known to provide a window having a number of louvres which can pivot between an open and closed position, and a nonreversible motor which is attached to one of the operating bars that operate the louvres. The motor is connected to the operating bar in between the top and the bottom of the bar which means that the motor must be positioned in the vertical part of the louvre surround frame, and this part is quite "cluttered" already with the operating bars, the rotatable disk members and the like. Thus, to conceal the motor, it is necessary to make the vertical part of the louvre surround frame larger than normal which is not desired. Alternatively, the motor must at least slightly protrude from a smaller louvre surround frame which is also not desirable. Also, there is no apparent "locking" mechanism which can be operated by the motor, so security concerns do not seem to be overcome.

Another type of motor driven louvre arrangement is described in US patent application 2005/0120628. A motor is positioned within the vertical part of the louvre surround frame and is attached to one of the operating bars. However, it does not seem possible to "lock" the louvres in the closed position merely by operation of the motor. The motor is positioned in a vertical part of the louvre surround frame, and this places great constraints on the size of the motor.

It also seems to be known to provide a motor driven louvre arrangement where the louvres are interconnected such that rotation of one louvre rotates all the other louvres, and where the motor is operatively connected to one of the louvres.

Therefore, it is known to provide an automated louvre system, and it is known to provide an automated louvre system where a drive motor is positioned within the louvre surround frame. However, the problem of security, and the ability to provide an adequate load to the louvres does not seem to have been solved, and other difficulties also do not appear to have been solved.

It will be clearly understood that, if a prior art publication is referred to herein, this reference does not constitute an admission that the publication forms part of the common general knowledge in the art in Australia or in any other country.

OBJECT OF THE INVENTION

It is an object to provide an automated louvre system that may overcome at least some of the above-mentioned disadvantages or provide a useful or commercial choice.

In one form, the invention resides in a motorised drive system for a louvre assembly of the type containing a surround frame, a pair of spaced apart operating bars positioned within the louvre surround frame and where movement of the operating bars causes rotation of the louvres, the drive system comprising a motor adapted to be positioned within the surround frame of the louvre assembly, the motor operationally driving a drive shaft which is substantially horizontal when the drive system is fitted within the louvre surround frame, a mounting member which is attached for rotation with the drive shaft, at least two spaced apart attachment points on the mounting member, a first link arm [13], an optional reinforcing bar [14], a second link arm [15], and a third link arm [16], the first link arm [13] being attached to one of the attachment points and to one said operating bar [18], the second link arm [15] being attached to another of the attachment points, the third link arm [16] being pivotally attached to the second link arm [15] and to the other operating bar.

This arrangement provides many benefits. Firstly, it enables the motor (typically an electric motor) to be placed in a upper horizontal part of the louvre surround frame which is generally free from "clutter" such as the operating bars etc. Secondly, the arrangement enables the motor to move the various link arms to a locking position where it is not possible to easily force the louvres from the closed position to the open position. In an embodiment, this is achieved by moving at least some of the link arms to a slightly "over centre" position which provides locking and which will be described in greater detail below. The louvres can also be closed quite tightly to provide a good barrier against water or air passing between the closed louvres.

In another form, the invention resides in a louvre assembly, and particularly a louvre window assembly of the type where the louvres are operated by a pair of spaced apart operating bars, and a drive system as described above to operate the operating bars and therefore the louvres.

The motor will typically comprise an electric motor, and this may be of the type having a generally cylindrical housing, and an output shaft extending from one end of the housing. The size and shape of the motor can vary.

The motor may be coupled to a gearbox or similar to improve the torque, vary the speed etc.

The gearbox may contain a drive shaft to which the mounting member can be either directly attached or operationally attached to such that rotation of the drive shaft will cause rotation or movement of the mounting member.

The louvre assembly will typically comprise some form of surround frame which has a pair of opposed vertical sections or members. A plurality of louvre blades (often simply called louvres), can be pivotally mounted typically to or relative to the vertical sections. The louvre blades will typically be made of glass, but can also be made of metal, wood, plastic, composite materials and the like. The size of the louvre assembly can vary depending, inter alia, on the size and number of louvres. A typical assembly will have a length of between 1-3 m, and a width of between 0.5-2 m. A typical assembly will have between 3-12 louvres. It should however be understood that no particular limitation is to be placed on the invention merely by describing a particular range of sizes.

The louvres are typically functionally interconnected such that all the louvres can open and close together. This is well-known. A well-known arrangement that can achieve this is to provide a pair of spaced apart operating bars in one vertical section of the surround frame. Each louvre has one end ultimately connected to a drive plate which is typically a circular disk member in the vertical frame section. Rotation of the drive plate will cause rotation of the attached louvre. The operating bars are attached to the drive plate. The operating bars can slide up and down in the surround frame and it is typical for one operating bar to slide up while the other operating bar slides down. This up-and-down movement of the operating bars causes rotation of the drive plate and therefore opening and closing of all the louvres. This is a well-known louvre operating system, and one form of the present invention has a drive system that can be attached and can operate the operating bars.

The drive system may contain a mounting member. The mounting member is typically operatively associated ultimately with the motor such that operation of the motor causes rotation of the mounting member. The mounting member can typically be rotated in both directions (e.g. clockwise and anticlockwise). Typically, the mounting member will be connected to an output shaft or output drive of the gearbox that is typically connected to the motor, although if a gearbox is not provided, the mounting member may be connected either directly or indirectly to the motor shaft.

It is preferred that the mounting member comprises a disk like or plate like member, and it is especially preferred that the mounting member is substantially circular and can therefore be seen as a wheel. However, it is also envisaged that the mounting member may comprise a rectangular plate, or something else, provided that the mounting member can support, have, or function to provide a pair of spaced apart attachment points.

The pair of spaced apart attachment points may comprise any thing to which something can be attached. Therefore, the attachment points may comprise pins, other types of projections, an opening, or any other profile to provide an "attachment point". It should also be appreciated that the term "point", unless the context requires otherwise, may also comprise an elongate area, or a plurality of points, and should not be limited only to a precise "point".

In a preferred embodiment of the invention, the mounting member provides the attachment for some of the link arms that form part of the drive system and which ultimately can raise and lower the operating bars to operate the louvres.

The link arms will typically comprise elongate, or substantially elongate members, which can be formed from metal, plastic, composite materials and the like. However, one or more of the link arms may also be oval, circular, and the like. The link arms will have a length which will depend on the type of link arm, and ultimately the size of the louvre assembly, but it is typical for the link arms to have a length of between 1-20 cm.

The first link arm will typically be attached to one of the attachment points on the mounting member. In a preferred embodiment, the mounting member contains small pins, and the link arm will contain a hole to enable the link arm to be typically attached via the pin to the mounting member. The first link arm will typically be attached to the mounting member to enable the rotary motion of the mounting member to be converted to linear motion on the link arm, this is typically being achieved via a "crank" type arrangement.

A lower part of the first link arm will typically be pivotally attached to an upper part of one of the operating bars which operate the louvres.

The second link arm [15] will typically be attached to the mounting member in a manner similar to that described with reference to the first link arm [13], although the second link arm will be mounted at a position spaced from the first link arm, and it is preferred that the attachment positions of the first link arm, and the second link arm, are to each side of the rotational axis of the mounting member but preferably not in linear alignment with the rotational axis and each other.

The second link arm will typically be pivotally attached to the third link arm [16], and the third link arm may be much shorter than the second link arm, and may be pivotally attached to an upper part of the other operating bar.

The third link arm may also be provided with a cam face and the reason for this will be described in greater detail below.

The system may also be provided with various guide faces to assist in proper movement of the various link arms. The guide faces may comprise part of a guide mount which can be fitted, typically at least partially between the spaced apart operating bars and the reason for this will be described in greater detail below.

BRIEF DESCRIPTION OF THE DRAWINGS

Embodiments of the invention will be described with reference to the following drawings in which:

FIG. 1. Illustrates the motorised drive system attached to the top of a pair of louvre operating bars by a link arrangement.

FIG. 2. Illustrates an end view of the drive system in the "louvre closed" position.

FIG. 3. Illustrates an end view of the drive system in the "louvre open" position.

FIG. 4. Illustrates a side view of the drive system.

FIG. 7. Illustrates a drive system according to a second embodiment of the invention and containing a modified first link arm.

FIG. 8. Illustrates a close up of the modified link arm of FIG. 7.

BEST MODE

Figure 5:
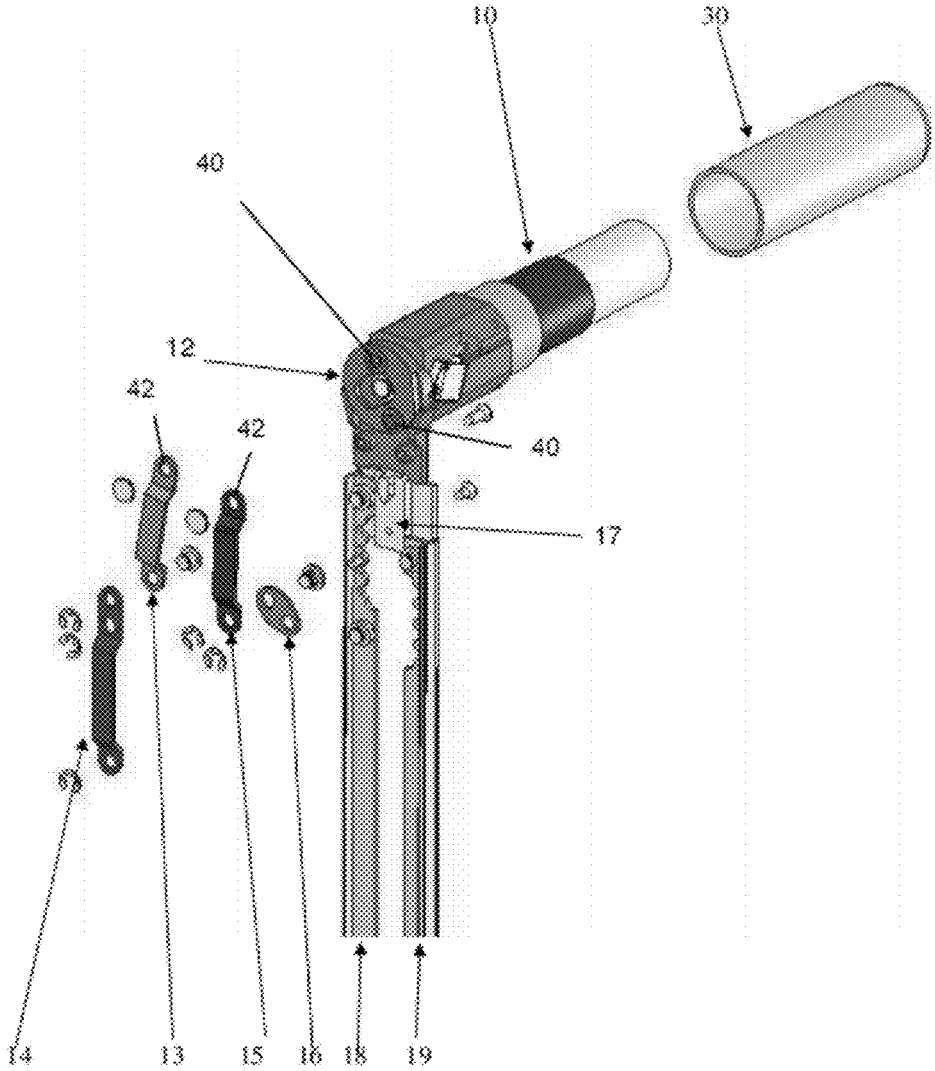
FIG. 5. Illustrates an exploded view of the drive system.

Referring initially to FIG. 1, there is illustrated the main components of the drive system. The main components comprise a electric motor 10, a motor cover 30, a gearbox 11, a mounting member in the form of a wheel 12, a first link arm 13, an optional reinforcing bar 14, a second link arm 15, a third link arm 16, a guide mount 17, a first operating bar 18, a second operating bar 19, and a louvre drive disk 20, which is attached to a particular louvre blade and which is positioned between, and operated by, the operating bars 18 and 19.

The drive system (that is the motor and the various link arms) can be fitted to an existing louvre operating system, or to a slightly modified louvre operating system, but which still uses the well-known principle of a pair of oppositely sliding operating bars 18, 19 which rotate a plurality of louvre drive disks 20, each disk being attached to a louvre blade.

The operating bars 18, 19 will be as long as is necessary such that all the louvre drive disks 20 can be rotated. Thus, these operating bars will typically have a length which is about the same as the length of the vertical section of the louvre surround frame, and the operating bars are positioned within the vertical section.

In the particular embodiment, each drive disks 20 comprises a cog having a number of circumferential teeth. The operating bar is provided with a "rack" 21 which can be stamped into the operating bar, with a rack being provided for each disk. Thus, if the louvre window assembly has ten louvres, there will be ten drive disks 20, and each operating bar will be formed with ten racks which can engage with the teeth on each disk. Thus, sliding movement of the operating bars 18, 19 will cause rotation of the respective disks 20 and therefore opening and closing of the various louvres. This is known.

Figure 6:
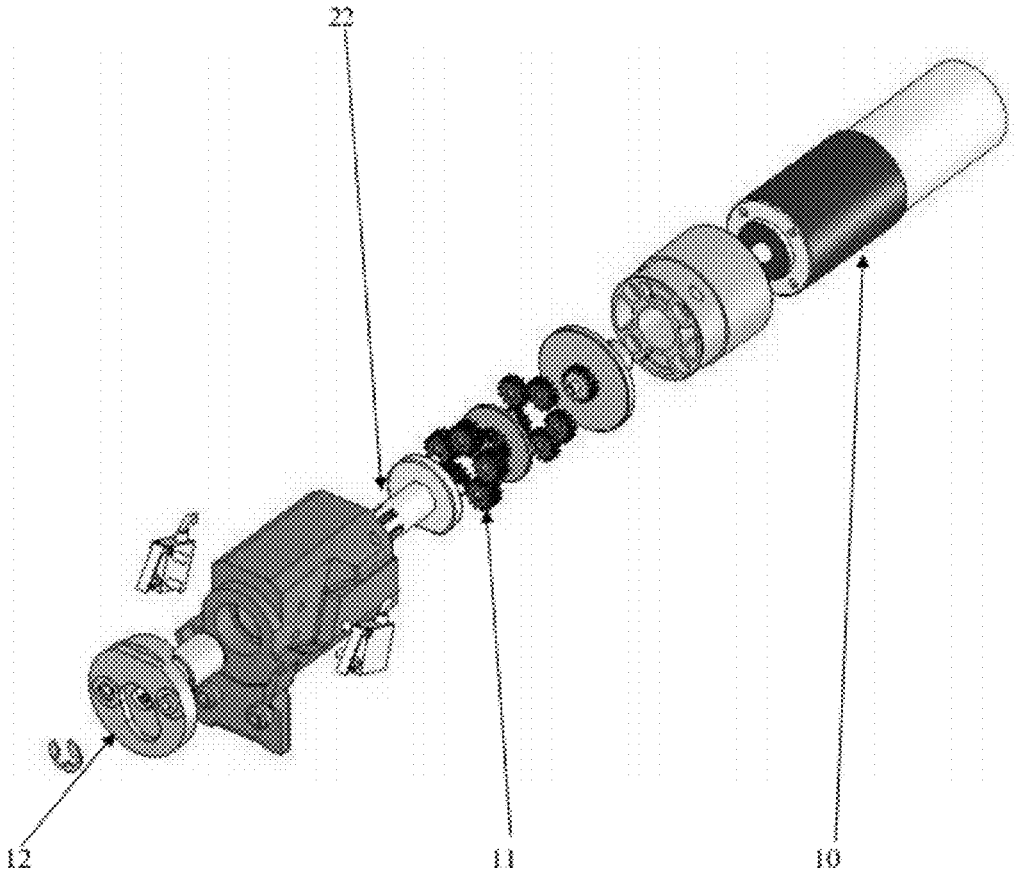
FIG. 6. Illustrates an exploded view of the motor and the gearbox arrangement.

In the particular invention, there is provided an automated system to automate the opening and closing of the louvres. The automated system includes an electric motor 10. Motor 10 is positioned in the upper horizontal section of the louvre surround frame. An advantage of this is that the motor 10 does not need to be positioned in the vertical section of the louvre surround frame which is already quite "cluttered" with the louvre operating mechanism (i.e. the operating bars, disks etc). Motor 10 is connected to a gearbox 11, and FIG. 6 is an exploded view of the gearbox. The gearbox contains an output shaft 22 which extends substantially horizontally because of the ability to position the motor in the upper horizontal section of the louvre surround frame.

Attached to output shaft 22 is the mounting member, which, in the particular embodiment, comprises a wheel 12. Wheel 12, in essence, functions as a crank mechanism. Wheel 12 has a pair of spaced apart attachment points 23, which are on each side of the rotation axis of the wheel, but preferably not diametrically opposed, to make the link arms work evenly for the first (last) 10-15 degrees of opening (closing) rotation of the louvres.

The first link arm 13 is pivotally attached to one of the attachment points on the wheel. Link arm 13 is somewhat U-shaped to provide clearance for other components that can pass underneath link arm 13.

The other end 24 of link arm 13 is pivotally attached to an upper end of first operating bar 18.

The second link arm 15 is shaped in a similar manner to first link arm 13 and is attached to the other attachment point of wheel 12. The lower end of second link arm 15 is pivotally attached to the "stubby" third link arm 16, and the third link arm 16 is pivotally attached to an upper end of the second operating bar 19. The wheel 12 contains small pins 40 (FIG. 5) and the first and second link arms 13 and 15 contain holes 42 (FIG. 5) to enable those link arms to attach to respective attachment points on the wheel 12 via the pins 40.

Operation of motor 10 causes rotation of wheel 12 either in a clockwise or anticlockwise direction, and the degree of rotation is sufficient to operate the operating bars 18, 19 to open or close the louvres.

However, there is also an advantage in the present arrangement to provide a "locking" condition to the louvres which improves security. There is also an advantage in the present arrangement where the mechanism can apply sufficient load to the blades to ensure an acceptable level of resistance to water and air penetration between the louvre blades.

This is achieved, in the embodiment, by having first link arm 13 able to adopt a slightly "over centre" position relative to the output shaft 22 of the gearbox. However, the problem that needs to be overcome (and which has been overcome in the embodiment) is that the advantageous ability to provide an over centre position means that the effective lengths of the links is not equal throughout the range of movement of the mechanism. The embodiment overcomes the problem of the varying effective lengths of the links in a controlled and predictable manner and without requiring undesirable alternatives such as elastic link members or providing excessive clearance in one or more of the pivots.

The particular arrangement of the second link arm 15 and the "stubby" third link arm 16 allows the varying effective lengths of the system to be taken up as the louvres open and close.

In the embodiment, there is provided a cam face 25 (see FIG. 2) which ensures that the link arms 15 and 16 are held rigid at the connection (pivot) point 26, and assist in opening the window while they are in contact with the cam face 25. Thus, the link arms 15 and 16 are held rigid until the louvre blades have pivoted through the first 10°-15° of opening where the force requirements is high. By keeping the link arms rigid, high forces can be applied directly to the operating bars during the initial period of the opening cycle.

The attachment points 23 on the wheel 12 are positioned in such a manner relative to each other such that they come into synchronisation during the last 10°-15° of movement of the louvres when closing and concurrently the first 10°-15° of movement when opening. This makes all three of the link arms (13, 15 and 16) work at the same time during this stage of the cycle which distributes the load evenly to both operating bars 18, 19.

The third link arm 16 is provided with a stop face 27 to prevent the three pivot points in link arms 15 and 16 from lining up and thus ensures that the connection point 26 kinks towards the centre during the opening operation. In an alternative embodiment, this could also be done with a spring attached to link arm 15 or link arm 16.

Guide mount 17 is provided with guide faces 28, 29 (see FIG. 2) which hold the operating bars 18, 19 from bending inwardly during operation.

The optional reinforcing bar 14 is provided in the present embodiment to increase the life of first operating bar 18.

Operation of the assembly from the closed position to the open position, and from the open position to the closed position will now be described.

Operation—Starting from the Closed Position (FIG. 2).

FIG. 2 shows the drive means in the closed position. When the system is activated, wheel 12 starts driving link arms 13 and 15 directly. Link arm 16 is driven via link arm 15. For the first 10°-15° of opening the louvre blades, all the link arms are driving the operating bars. As link arm 16 moves beyond cam face 25, the link arms 15 and 16 are able to "kink" to take up the "varying effective lengths" created in the system. When the "kinking" motion starts, the connection point 26 naturally moves inwards due to the stop face 27. The system then continues to open until the open position micro-switch 32 is activated via a cam face on the wheel 12.

Operation—Starting from the Open Position (FIG. 3).

FIG. 3 shows the drive means in the open position. When the system is activated, wheel 12 starts driving link arms 13 and 15 directly. At this stage link arm 13 is the only arm driving the louvre blades. As the louvre blades reach their last 10-15° of travel, the system comes into synchronisation due to the position of the attachment points 23 on wheel 12, and at the same time, link arms 15 and 16 straighten to their limits due to the restriction of stop face 27. From this point on, link arms 15 and 16 work as "one arm" pulling on their respective operating bar 19 which balances out the load on the louvre bearings. Wheel 12 continues to rotate (close) until a cam face on the wheel 12 contacts the closed position micro-switch 33. At this closed position, the centre line of both link arms 13 and 15 align with the axis of rotation of wheel 12. This, along with the friction reduction in the gearbox, prevents the louvre blades from being forced open as the load applied through the link arms is directly through the axis of wheel 12 and does not apply any torque load to wheel 12 (i.e. an over centre mechanism).

FIG. 7-8 illustrate a slightly modified version of the drive system. The drive system is essentially the same as the system described above except that the first link arm 31 is slightly modified. The link arm contains a pair of "up stands" 32 such that when the link arm is compressed, the link arm will flex slightly, and the up stands 32 will touch the vertical extrusions section which increases the strength of the link arm.

The arrangement therefore allows a "conventional" louvre operating system to be automated. The advantageous ability to lock the louvre blades using an over centre mechanism can be achieved and the problem with length variation in the links has been overcome with the particular link arrangement.

Throughout the specification and the claims (if present), unless the context requires otherwise, the term "comprise", or variations such as "comprises" or "comprising", will be understood to apply the inclusion of the stated integer or group of integers but not the exclusion of any other integer or group of integers.

Throughout the specification and claims (if present), unless the context requires otherwise, the term "substantially" or "about" will be understood to not be limited to the value for the range qualified by the terms.

It should be appreciated that various other changes and modifications can be made to any embodiment described without departing from the spirit and scope of the invention.

The invention claimed is:

1. A motorised drive system for driving a louvre assembly, the louvre assembly having a surround frame, first and second spaced apart operating bars positioned within the surround frame and where movement of the operating bars causes rotation of the louvres, the drive system comprising a motor adapted to be positioned within the surround frame, the motor operationally driving a drive shaft which is substantially horizontal when the drive system is fitted within the surround frame, a mounting member which is attached for rotation with the drive shaft, at least a first and a second attachment point spaced apart on the mounting member, a first link arm, a second link arm and a third link arm, the first link arm having a portion pivotally attached the first attachment point and another portion pivotally attached the first operating bar, the second link arm having a portion pivotally attached the second attachment point and another portion pivotally attached to a portion of the third link arm, the third link arm having another portion pivotally attached to the second operating bar wherein the second link arm and the third link arm can pivot relative to one another during at least part of the movement thereof that causes rotation of the louvres, wherein the distance between the portion of the first link arm attached to the first attachment point and the portion of the first link arm attached to the first operating bar comprises a first link length, the distance between the portion of the second link arm attached to the second attachment point and the portion of the third link arm attached to the second operating bar comprises a second link length, and the second link length varies and does not remain equal to the first link length throughout a range of movement of the drive system, but the relative pivoting between the second link arm and the third link arm allows this varying length to be taken up in a controlled manner as the louvres open and close.

2. A motorised drive system as claimed in claim 1 having a reinforcing bar to reinforce the first operating bar.

3. A motorised drive system as claimed in claim 1, wherein the motor is adapted to be placed in a horizontal part of the surround frame.

4. A motorised drive system as claimed in claim 3, wherein the motor is adapted to be placed in an upper horizontal part of the surround frame.

5. A motorised drive system as claimed in claim 1, wherein the motor comprises an electric motor.

6. A motorised drive system as claimed in claim 1, wherein moving at least some of the link arms to a slightly over centre position provides locking of the louvres.

7. A motorised drive system as claimed in claim 1 wherein the louvres can be closed to provide a barrier against water or air passing between the closed louvers.

8. A motorised drive system as claimed in claim 1, wherein the mounting member comprises a disk shaped member.

9. A motorised drive system as claimed in claim 8, wherein the mounting member is substantially circular.

10. A motorised drive system as claimed in claim 8, wherein the first and second attachment points are to each side of the rotational axis of the mounting member but not in linear alignment with the rotational axis and each other.

11. A motorised drive system as claimed in claim 10, wherein the positions of the first attachment points and the second attachment point enable the link arms to work evenly for the first 10-15 degrees of opening rotation of the mounting member and for the last 10-15 degrees of closing rotation of the mounting member.

12. A motorised drive system as claimed in claim 11, wherein the mounting member contains small pins, and the first and second link arms contain holes to enable those link arms to pivotally attach to respective attachment points on the mounting member via the pins.

13. A motorised drive system as claimed in claim 1, wherein the first link arm is pivotally attached to an upper part of the first operating bar.

14. A motorised drive system as claimed in claim 13, wherein the first link arm is attached to the mounting member in such a way as to enable the rotary motion of the mounting member to be converted into substantially linear motion of that link arm.

15. A motorised drive system as claimed in claim 1, wherein a cam face is provided for holding the second link arm and the third link arm rigid at the pivotal connection therebetween during at least part of the drive system's range of motion.

16. A motorised drive system as claimed in claim 15, wherein the cam face causes the second and third link arms to be held rigidly until the louvre the blades have pivoted through the first 10-15 degrees of opening rotation and through the last 10-15 degrees of closing rotation.

17. A motorised drive system as claimed in claim 16, wherein all three link arms work at the same time and distribute a load evenly to the operating bars during the first 10-15 degrees of opening rotation and during the last 10-15 degrees of closing rotation.

18. A motorised drive system as claimed in claim 1, wherein the motor is coupled to a gearbox.

19. A motorised drive system as claimed in claim 18, wherein the gearbox contains the drive shaft and rotation of the drive shaft causes rotation of the mounting member.

20. A motorised drive system as claimed in claim 1, wherein the mounting member is connected either directly or indirectly to the motor.

21. A motorised drive system as claimed in claim 1, wherein the mounting member can be rotated in both directions.

* * * * *